US006176493B1

(12) United States Patent
Whipps

(10) Patent No.: US 6,176,493 B1
(45) Date of Patent: Jan. 23, 2001

(54) SLIDE GATE AND SEAL THEREFOR

(76) Inventor: George E. Whipps, 176 Batchelder Rd., Athol, MA (US) 01331

( * ) Notice: Under 35 U.S.C. 154(b), the term of this patent shall be extended for 0 days.

(21) Appl. No.: 09/248,415

(22) Filed: Feb. 11, 1999

(51) Int. Cl.[7] ..... F16J 15/02

(52) U.S. Cl. ..... 277/630; 277/642; 277/644; 405/104; 405/106

(58) Field of Search ..... 49/348, 362, 340, 49/341; 405/103, 104, 105, 106; 277/630, 637, 641, 642, 644, 640, 906

(56) References Cited

U.S. PATENT DOCUMENTS

| | | | | |
|---|---|---|---|---|
| 1,969,640 | * | 8/1934 | Curtin | 277/640 |
| 2,566,777 | * | 9/1951 | Schmidt | 277/640 |
| 4,165,083 | * | 8/1979 | Dochnahl | 277/637 |
| 4,226,553 | * | 10/1980 | Whipps et al. | 405/106 |
| 4,700,927 | * | 10/1987 | Henderson | 251/158 |
| 4,726,709 | * | 2/1988 | Labelle | 405/103 |
| 4,848,962 | | 7/1989 | Whipps | 405/106 |
| 4,877,352 | * | 10/1989 | Tuttle et al. | 405/104 |
| 5,141,361 | | 8/1992 | Fontaine | 405/106 |

OTHER PUBLICATIONS

H. Fontaine Ltd., "Stainless Steel Sluice Gates", Series 20, Flow Control Sluice Gates, 3 pages, dated Oct. 1997; Jul. 1997; and May 1998.

Rodney Hunt Co., "The Integral Frame Sluice Gate", 2 pages, date unknown.

Rodney Hunt Co., "The Universal Frame Sluice Gate", 2 pages, date unknown.

Rodney Hunt Co., "The Typical Sluice Gate Installation", 2 pages, date unknown.

Rodney Hunt Co., "Series 600 Stainless Steel Gates", 3 pages, date unknown.

Rodney Hunt Co., "The Wedge System", 1 page, 1979 catalog.

Plasti–Fab, Inc., "Special Gate Designs", 1 page, dated 1983.

* cited by examiner

*Primary Examiner*—Anthony Knight
*Assistant Examiner*—Vishal Patel
(74) *Attorney, Agent, or Firm*—Pandiscio & Pandiscio

(57) ABSTRACT

A novel side seal assembly for a slide gate is provided that essentially comprises a seal member having first, second and third mutually spaced sections formed integral with a base section, the first and second sections defining a slide-receiving channel and the second and third sections defining a tapered wedge-receiving channel, said second section being capable of flexing away from said first section toward said third section under a flexing force applied thereto; a tapered wedge member for disposition in said wedge-receiving channel; and attachment means for attaching said seal member and said wedge member to a gate slide guide, said attachment means including fastener means for retaining said wedge member at a selected depth in said wedge-receiving channel, said wedge member acting on said said second and third sections to produce a flexing force that causes said second section to flex toward said first section whereby to cause said first and second sections to engage and form a watertight sliding seal with opposite surfaces of a slide disposed in said slide-receiving channel.

18 Claims, 3 Drawing Sheets

SLIDE GATE AND SEAL THEREFOR

BACKGROUND OF THE INVENTION

1. Field of the Invention

This invention relates to slide gates for controlling fluid flow and, more particularly, to an improved slide gate seal.

2. Description of the Prior Art

Slide gates are employed to control fluid flow through a passageway or channel. A slide gate has a frame assembly which defines an opening through which fluid flows, a slide comprising a slide plate selectively mounted to the frame assembly and adapted for vertical movement relative thereto so as to selectively open and close the opening, sealing members for providing a watertight seal between the slide plate and frame assembly, and operating means for vertically moving the slide between open and closed positions for regulating fluid flow through the opening. Generally, the frame assembly is mounted to the walls surrounding or defining the passageway or channel through which the fluid flows in such a manner that substantially all of the fluid flows through the opening in the frame assembly. In this way, fluid flow through the opening of the slide gate is determined by the position of the slide within the frame assembly. Typical slide gates and their sealing members are shown in U.S. Pat. Nos. 3,760,593; 4,028,896; 4,226,533; 4,848,962, and 5,141,361.

The degree of success attained by prior slide gates has been determined in part by the limitations of the seals which are used to provide a watertight connection between the slide and the frame assembly. The problems and disadvantages of prior seal designs are described in my U.S. Pat. No. 4,848,962 (hereafter the '962 Patent). To the extent that it is necessary to do so, the description of the prior art and the features and details of construction disclosed by the '962 Patent are incorporated herein by reference thereto.

The '962 Patent discloses certain improvements in slide gate seats which overcome limitations of prior commonly used seals. A significant advantage of the side seals disclosed in the '962 Patent is that they are adjustable to vary the amount of force exerted by them on the slide. However, the range of such adjustment is limited.

SUMMARY OF THE INVENTION

A primary object of the invention is to provide a new and improved slide gate seal.

A more specific object is to improve upon the side seals disclosed in the '962 Patent.

A further object is to provide a novel side seal for a slide gate assembly that can be adjusted to provide a sliding watertight engagement with slides of different thicknesses or slides that are tapered from top to bottom.

Another object is to provide a novel side seal for a slide gate assembly which assures a water-tight sealing action and can be adjusted with relative ease to vary its contact pressure with the slide so as to optimize the operating force required to raise the slide to channel-unblocking position or lower the slide to channel-blocking position.

Still another object is to provide an improved form of side seal for a slide gate that is easy to install or replace, predictable with respect to the amount of drag it produces on the slide gate, and is less expensive to manufacture than the side seals disclosed in the '962 Patent.

Another primary object is to provide a slide gate assembly that is characterized by a novel side seal which assures a watertight sealing action, can be adjusted to accommodate slides of different thicknesses.

A further object is to provide a slide gate assembly that has novel side seals which can be adjusted to vary the force of their engagement with the slide, so as to optimize the operating force required to raise the slide to channel-unblocking position or lower the slide to channel-blocking position.

A further object is to provide a slide gate assembly that comprises an improved form of slide gate seal that is easy to install or replace, and can be adjusted to vary the amount of drag it exerts on the slide and to accommodate variations in thickness of the slide gate, all while offering the advantage of a water-tight sealing action.

The foregoing objects are achieved by a novel seal assembly that essentially comprises a seal member having a base section, and first, second and third mutually spaced sections formed integral with said base section, said first and second sections defining a slide-receiving channel and said second and third sections defining a tapered wedge-receiving channel; a tapered wedge member for disposition in said wedge-receiving channel; and attachment means for attaching said seal member and said wedge member to a gate slide guide, said attachment means including fastener means for retaining said wedge member at a selected depth in said wedge-receiving channel, said seal member being made of a material that allows said second section to flex away from said first section toward said third section under a flexing force produced by said wedge member acting on said second and third sections, whereby to cause said first and second sections of said seal member to engage opposite surfaces of a slide that is disposed in said slide-receiving channel, with said first and second sections forming a watertight sliding seal with said inserted slide.

Other objects, features and advantages of the invention are set forth in the following detailed description which is to be considered together with the accompanying drawings.

DETAILED DESCRIPTION OF PREFERRED EMBODIMENT

Figure 1:
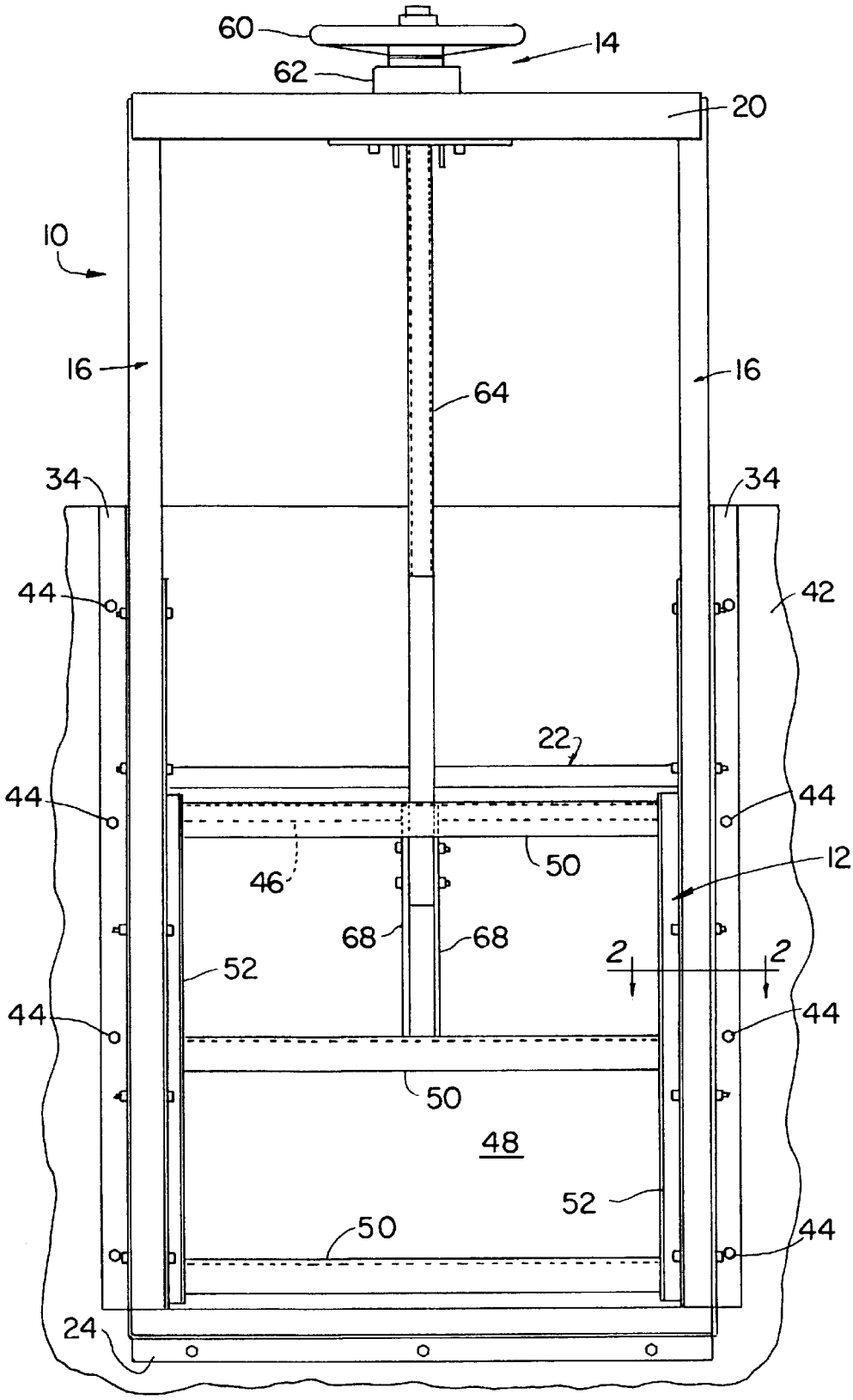
FIG. 1 is a front view of a bolt-on slide gate assembly embodying the present invention.

Referring now to the drawings there is shown a slide gate assembly that embodies the present invention. The slide gate (also known as a sluice gate) comprises a metal frame assembly 10, a slide 12, and a metal slide plate operator 14.

Figure 2B:
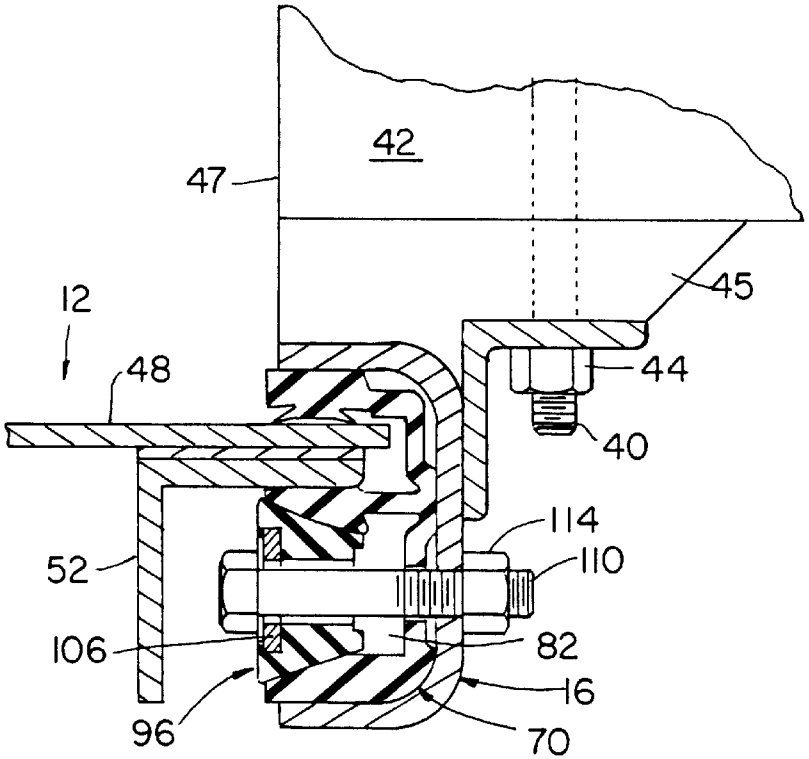
FIG. 2B is a sectional view taken along line 2—2 of FIG. 1 showing the side seal adjusted to accommodate a side gate that has a second, relatively great, thickness.
Figure 2A:
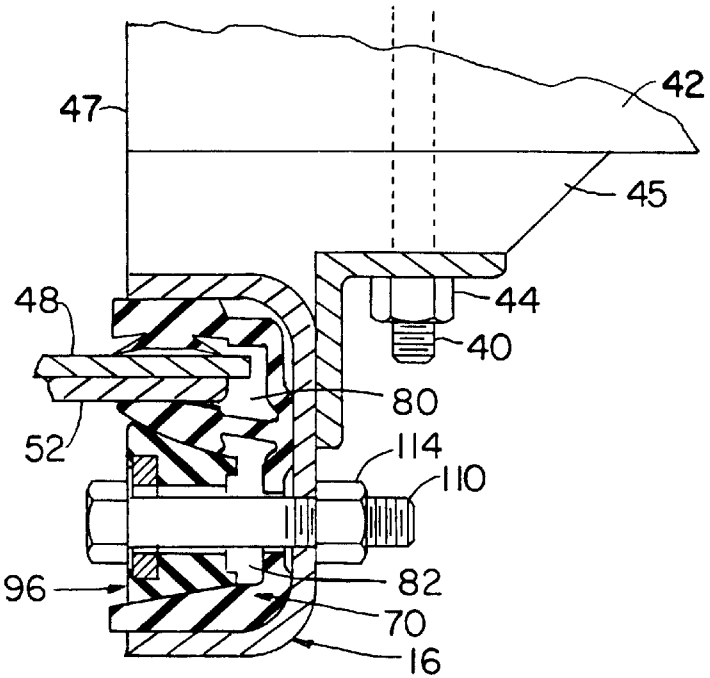
FIG. 2A is a sectional view taken along line 2—2 of FIG. 1 showing the side seal adjusted to accommodate a side gate that has a first, relatively small, thickness.
Figure 3:
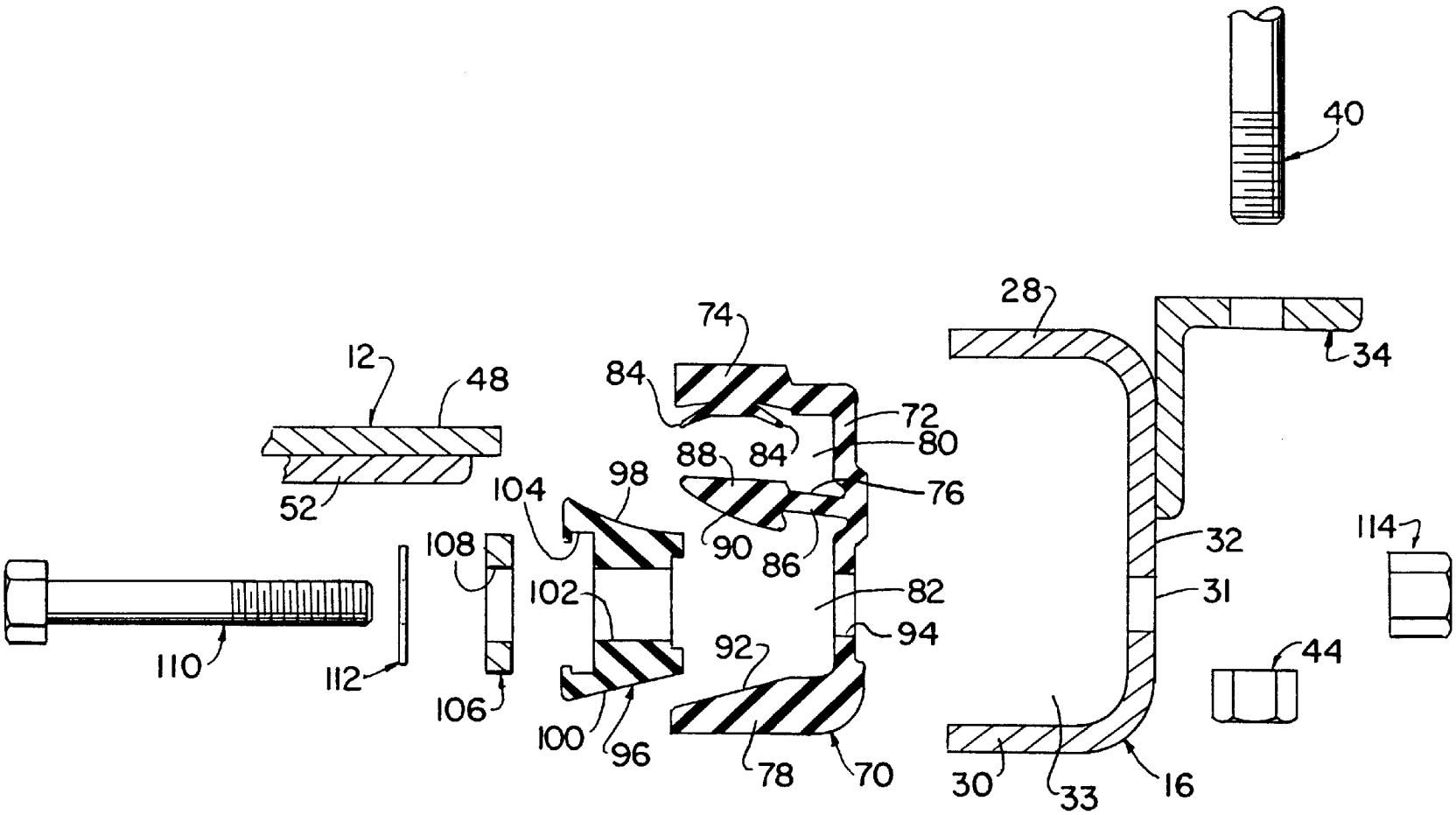
FIG. 3 is a fragmentary exploded view showing a portion of the slide gate, one of the side guides and side guide seals for the slide gate, and fastener components used to secure the side guide to a channel wall and to secure the seal components to the guide channel in sealing relation to the slide.

Frame assembly 10 includes a pair of metal side gate guides 16, a top metal frame member 20, an intermediate horizontal metal frame member 22 and an bottom metal frame member 24. Preferably the foregoing members are all welded together to form a unitary rigid welded, although other means of attachment may be used. As seen in FIGS. 2A and 2B, each of the side gate guides 16 comprises a substantially U-shaped channel member having side walls 28 and 30 and a bottom wall 32 that define a channel 33, plus a bracket member 34 of L-shaped cross-section that is welded to bottom wall 32. Each guide also has a series of bolt holes 31 along its length (FIG. 3). In the preferred embodiment, each side gate guide 16 is composed of stainless steel or similar material. The bracket members 34 are provided with holes to accommodate anchoring bolts 40 that are anchored in a concrete wall 42 and are threaded to receive nuts 44 that coact with bolts 40 to anchor the weldment to the cement wall. Preferably a layer of grout 45 is disposed between the bracket members and the concrete wall, as shown in FIGS. 2A, 2B, so as to form a watertight connection between the bracket members and the concrete wall. The concrete wall forms part of a dam or a side wall in a concrete basin, holding tank or lagoon. The concrete wall 42 has an waterway opening through which flow of water into or out of the basin, holding tank or lagoon is controlled by the slide gate. Only part of the waterway opening is shown in the drawings, the top edge 46 and one of the side edges 47 of the waterway opening being represented in FIGS. 1 and 2A (also 2B) respectively.

Although the illustrated embodiment has a single elongate bracket member 34 at each side, it should be appreciated that each of those bracket members may be replaced by a plurality of mutually spaced relatively short angle brackets. The guides 16 are arranged so that the open portion of channel 33 of one side gate guide faces the open portion of channel 33 of the other slide gate guide. In the illustrated embodiment, the two gate guides 16 run for the full length of the frame assembly 10. However, the seal members hereinafter described extend for a shorter length, from at or below the bottom edge of the waterway opening to a selected distance above the top edge 46 of the waterway opening.

The gate guides 16, horizontal frame member 22 and bottom member 24 coact to completely surround the waterway opening in concrete wall 42 through which fluid flows. Horizontal member 22 is secured to concrete wall 42 in a way that causes it to form a water-tight extension of the concrete wall 42 above the upper edge 46 of the waterway opening. A top seal (not shown) is attached to horizontal member 22 in facing relation to the slide 12. The form of top seal is not critical to this invention. Thus, for example, it may be like the top seal shown in FIG. 5 of the '962 Patent. The bottom member 24 also is secured to concrete wall 42 in the same manner as brackets 34. Bottom member 24 supports a bottom seal (not shown). The form of the bottom seal is not critical to this invention. Thus, for example, it may be like the bottom seal shown in FIG. 4 of the '962 Patent; or it may be a seal like the hereinafter described side seals that embody the present invention.

The slide 12 comprises a metal slide plate 48, and a plurality of horizontal metal stiffener members 50 that preferably are in the form of angle irons as shown, and a pair of vertical metal stiffener members 52 that are attached to slide plate 48 at its opposite side edges as shown. Preferably the members 52 also are in the form of angle irons. As is obvious from FIGS. 2A and 2B, the side stiffener members 52 also increase the effective thickness of the slide at its side edges. Members 52 and slide plate 48 may have a constant thickness or one or the other or both may be tapered from top to bottom.

Top frame member 20 supports slide operator 14 which moves slide 12 vertically relative to frame assembly 10. The slide operator includes a handwheel 60 that is connected to a nut (not shown) which is journalled for rotation in a housing 62. Housing 62 is mounted to top frame member 20. A threaded spindle or stem 64 extends through the nut in housing 62 and up through the handwheel 60. Spindle 64 is secured at its lower end to the slide plate 48. Preferably, but not necessarily, this is accomplished by bolting it to a pair of parallel bars 68 that are affixed to the slide plate. By turning handwheel 60 in one direction, the slide 12 is raised upwards along the frame assembly 10 into a position that unblocks the waterway opening in the concrete wall. By turning the handwheel in the opposite direction, the slide 12 is lowered within the frame assembly to any selected height or until its bottom edge engages the bottom seal (not shown) that is supported by the bottom frame member 24.

Referring now to FIGS. 2A, 2B and 3, a resilient side seal assembly is seated within each U-shaped channel 33. Each side seal assembly comprises an elongate side seal member 70 that is preferably formed by an extrusion process and is composed of a selected non-metallic material having a relatively low coefficient of friction. Seal members 70 may be made of a polymeric material that has elastomeric or near-elastomeric properties. Preferably the seals are made of an ultra high molecular weight (UHMW) polyethylene which has a relatively low coefficient of friction and is stiff yet offers sufficient flexibility and resiliency to function as a sealing member. Side seal members 70 extend along the side gate guides 16 for an extended length that is substantially greater than the vertical dimension of the waterway opening in the concrete wall, preferably at least equal to but preferably in excess of the sum of the vertical dimension of slide 12 and 50% of the length of its stroke in moving between its raised fully open position and is lowered fully closed position.

Each side seal member 70 is in the form of an elongate strip and, as viewed in cross-section in FIG. 3, comprises a base section 72, and first, second and third mutually spaced sections 74, 76 and 78 respectively that are formed integral with base section 72. The first and second sections 74 and 76 define a slide-receiving channel 80 (FIG. 3) and said second and third sections define a tapered wedge-receiving channel 82 (FIG. 3). The first section 74 is formed with a pair of relatively flexible lips 84 on its inner surface. The lips 84 extend away from one another and also inwardly toward section 76. The second section 76 comprises a relatively thin web portion 86 and a bulbous portion 88 that has a flat or gently curved outer surface 89 and an inner surface 90 that extends at an acute angle to section 78 and at an acute angle to base section 72. Preferably surface 90 is slightly convex in cross-section, as seen in FIG. 3, although it may be made so that it is substantially flat. The web portion 86 allows the portion 88 to be moved toward section 78. As shown in FIG. 3, the section 78 has an inner surface 92 that is essentially flat. Surface 92 extends at an acute angle to surface 90 and at an acute angle to base section 72. The surfaces 90 and 92 cooperate to cause channel 82 to be substantially tapered in cross-section. Seal member 70 also has a series of mutually spaced holes 94 formed in base section 72 at the bottom of channel 82. Holes 94 are aligned with holes 31 in guides 16.

Each side seal assembly also comprises a tapered wedge member 96 that also is extruded in the form of an elongate strip and is shaped for disposition in said wedge-receiving channel 82. Wedge member 96 is made of a material that is the same or has substantially the same properties as seal member 70. As shown in FIG. 3, wedge member 96 has a slightly concave side surface 98 and a relatively flat side surface 100 that are adapted to mate with surfaces 90 and 92 respectively of seal member 70. Wedge member 96 has a plurality of mutually spaced holes 102 disposed along its length. The inner surface of wedge member 96 also has a flat rectangular groove 104 to accommodate a metal reinforcing strip 106 that has a series of mutually spaced holes 108 that are aligned with holes 102. The side seal assembly is completed by a plurality of metal bolts 110, metal washers 112 and metal nuts 114. The bolts extend through washers 112, holes 108, 102, 94 and 31 and are engaged by nuts 114.

Still referring to FIGS. 2A, 2B and 3, each side edge of slide 12 extends into the channel 80 of the associated seal member 70, with one side of the slide engaging the lips 84 and the other side of the same plate engaging the adjacent surface 89 of the second section 76 of the seal member. When the wedge member is inserted into channel 82, its side surfaces 98 and 100 engage the surfaces 90 and 92 of the section 76 and 78 respectively. The further that the wedge member is forced into channel 82 by tightening nuts 114 on bolts 110, the more the wedge member forces the center section 76 of the seal member to bend away from third section 78 toward first section 74, thereby increasing the drag imposed on the slide by lips 84 and the adjacent surface of section 75. It should be noted that the side walls 28 and 30 of guides 16 restrain the seal sections 74 and 78 so that they cannot spread apart when slide 12 and wedge member 96 are inserted into channels 80 and 82 respectively.

As illustrated by FIGS. 2A and 2B, the thickness of the slide may vary. In FIG. 2 the effective thickness of the slide is the thickness of slide plate 48 and the thickness of the adjacent portion of the associated side stiffener member 52. In FIG. 2A, the effective thickness of the slide is increased by the presence of an intermediate metal spacer member 116. Nevertheless, the wedge-type seal construction permits the seal assemblies to accommodate the thicker slide. Additionally, if the slide is tapered in thickness from top to bottom, the force applied to wedge member 96 may be varied from top to bottom by adjusting nuts 114.

The lips 84 are relatively flexible due to their shape and relatively thin cross-section. Accordingly the lips can move to compensate for variations in the flatness of the slide or the stiffener members 52. This capability avoids the need to provide the surfaces of the slide assembly with a polished finish. At the same time the lips assure that the seal member forms a watertight sliding seal with the slide.

The present invention offers several advantages over my prior side seal design. It is less expensive to manufacture and has better adjustability and a greater range of adjustment for greater range of slide thicknesses. The seal assemblies of this invention are also relatively easy to install or to remove for repair or replacement. Other advantages will be apparent to persons skilled in the art.

Since certain changes may be made in the foregoing disclosure without departing from the scope of the invention herein involved, it is intended that all matter contained in the foregoing description and depicted in the accompanying drawings be construed in an illustrative and not in a limiting manner.

What is claimed is:

1. A slide gate mechanism for controlling fluid flow through an opening in a wall, said slide gate mechanism comprising:

(a) a frame assembly having first and second gate guide members for disposition along the sides of said opening and at least two members extending and interconnecting said first and second gate guide members;

(b) a slide extending between said first and second gate guide members;

(c) operating means carried by said frame assembly and connected to said slide, said operating means being operable to selectively move said slide in one direction or an opposite direction along said guide members so that said slide plate may be disposed in blocking or unblocking relation with said opening;

(d) a seal member associated with each of said first and second gate guide members respectively, said seal member including first lip seal means and resilient seal means, the margins of said slide plate being received between said lip seal means and said resilient seal means, said seal member also comprising a wedge-receiving channel that is defined in part by said resilient seal means and in part by another portion of said seal member;

(e) a wedge member disposed in said channel in engagement with said resilient seal means and said another portion of said seal member so as to cause said resilient seal means to press against the margin of one face of said slide and urge said slide into engagement with said lip seal means; and (f) adjustable retainer means connecting said seal member and said wedge member to one of said gate guide members, said retainer means extending through said wedge member and a portion of said seal member and being adjustable to vary the depth of penetration of said channel by said wedge member so as to vary the force with which said wedge member presses said resilient seal means against said slide.

2. A slide gate as claimed in claim 1, wherein each of said gate guide members defines a seal-receiving channel, and said seal members are disposed in said seal-receiving channels.

3. A slide gate mechanism according to claim 1 wherein said retainer means comprises a plurality of threaded fasteners.

4. A slide gate mechanism according to claim 1 wherein said seal member and said wedge member are both made of a polymeric material.

5. A seal assembly for engaging and forming a watertight sliding connection with the margin of a slide, said seal assembly comprising:

a seal member associated with each of said first and second gate guide members respectively, said seal member including a base section and lip seal means and resilient seal means attached to and projecting from said base section, the margins of said slide plate being received between said lip seal means and said resilient seal means, said seal member also comprising a wedge-receiving channel that is defined in part by said resilient seal means and in part by another portion of said seal member that is attached to and projects from said base section, said channel being tapered so that its width increases with increasing distance from said base section; and a tapered wedge member disposed in said channel in engagement with said resilient seal means and said another portion of said seal member so as to cause said resilient seal means to press against the margin of one face of said slide and urge said slide into engagement with said lip seal means, the amount of force exerted on said resilient seal means by said wedge member being a function of the depth of penetration of said channel in the direction of said base section by said wedge member.

6. A seal assembly according to claim 5 further including a guide member surrounding portions of said seal member, and means for locking said seal member and said wedge member to said guide member.

7. A seal assembly for engaging and forming a watertight sliding connection with the margin of the slide of a slide gate, said seal assembly comprising:

an elongate seal member made of a non-metallic material and comprising first, second and third sections projecting from a base section, said first and second sections defining a first channel extending longitudinally of said seal member for receiving the side margin of a slide, said second section having a portion thereof that is movable toward said first section whereby to diminish the width of said first channel, said second and third sections defining a second channel extending parallel to said first channel, said channel being tapered in cross-section with its width increasing with increasing distance from said base section; and an elongate wedge member adapted for insertion into said second channel for engagement with said second and third sections so as to press said portion of said second section toward said first section and thereby narrow the width of said first channel, said wedge member being shaped so that the amount of force that it exerts on said second section is a function of the depth of penetration of said second channel by said wedge member; said seal member and said wedge member having openings for accepting fastener means for locking said wedge member to said seal member.

8. A seal assembly according to claim 7 in combination with a channel-shaped guide member having a base wall and first and second side walls, said base wall engaging said base section and said first and second side walls extending outside of and along said first and third sections, and fastener means for releasably locking said seal member and said wedge member to said guide member and for adjusting the depth of penetration of said wedge member in said second channel, said fastener means extending through said openings in said wedge member and said seal member and being attached to said guide member.

9. A slide gate mechanism for controlling fluid flow through an opening in a wall, said slide gate mechanism comprising:

(a) a frame assembly having first and second gate guide members for disposition along the sides of said opening and at least two members extending and interconnecting said first and second gate guide members;

(b) a slide extending between said first and second gate guide members;

(c) operating means carried by said frame assembly and connected to said slide, said operating means being operable to selectively move said slide in one direction or an opposite direction along said guide members so that said slide plate may be disposed in blocking or unblocking relation with said opening;

(d) a seal member associated with each of said first and second gate guide members respectively, said seal member including first lip seal means and resilient seal means, the margins of said slide plate being received between said lip seal means and said resilient seal means, said seal member also comprising a tapered channel that is defined in part by said resilient seal means and in part by another portion of said seal member;

(e) a tapered wedge member disposed in said tapered channel in engagement with said resilient seal means and said another portion of said seal member so as to cause said resilient seal means to press against the margin of one face of said slide and urge said slide into engagement with said lip seal means; and (f) adjustable retainer means connecting said seal member and said wedge member to one of said gate guide members, said retainer means being adjustable axially to vary the depth of penetration of said tapered channel by said wedge member so as to vary the force with which said wedge member presses said resilient seal means against said slide.

10. A seal assembly for engaging and forming a watertight sliding connection with the margin of the slide of a slide gate, said seal assembly comprising:

an elongate seal member made of a non-metallic material having elastomer or near-elastomer properties, said seal member comprising first, second and third sections projecting from a base section, said first and second sections defining a first channel extending longitudinally of said seal member for receiving the side margin of a slide, said second section having a portion thereof that is movable toward said first section whereby to diminish the width of said first channel, said second and third sections defining a second channel extending parallel to said first channel, said channel being tapered in cross-section with its width increasing with increasing distance from said base section; and an elongate wedge member adapted for insertion into said second channel, said wedge member having first and second opposite side surfaces for engagement with said second and third sections respectively so as to press said portion of said second section toward said first section and thereby narrow the width of said first channel, said first and second opposite side surfaces being slanted toward one another so that said wedge member is tapered, whereby the amount of force exerted by said wedge member on said second section in the direction of said first section is a function of the depth of penetration of said second channel by said wedge member;

said wedge member and said base section of said seal member having a plurality of aligned holes for accepting fasteners for connecting said wedge member to said seal member.

11. A seal assembly according to claim 10 wherein one of said first and second sections of said seal member includes lip seal means and the other of said first and second sections of said seal member has a flat surface facing said lip seal means.

12. A seal assembly according to claim 10 wherein said wedge member is made of a non-metallic material.

13. A seal assembly according to claim 10 further including a reinforcing strip engaged with said elongate wedge member.

14. A seal assembly according to claim 10 further including a channel-shaped gate guide member having a base wall and first and second side walls, said base wall engaging said base section and said first and second side walls extending outside of and along said first and third sections, and means comprising fasteners that are sized to extend through said aligned holes for releasably locking said seal member and said wedge member to said base wall of said gate guide member and for adjusting the depth of penetration of said wedge member in said second channel.

15. A seal assembly according to claim 14 wherein said elongate wedge member has an outer side and an inner side with said opposite side surfaces thereof extending between said outer and inner sides and said outer side of said wedge member having an elongate groove, and further including a reinforcing strip residing in said groove.

16. A seal assembly according to claim 15 wherein said reinforcing strip has a plurality of openings, and said fasteners extend through said openings.

17. In combination with an elongate guide member for the slide of a slide gate mechanism, a seal assembly for engaging and forming a watertight sliding connection with the margin of the slide, said seal assembly comprising:

an elongate seal member including first and second mutually spaced resilient seal means, said guide member surrounding portions of said seal member and the margins of said slide plate being received between said first and second seal means, said seal member also comprising a wedge-receiving channel extending lengthwise thereof that is defined in part by one of said seal means and in part by another portion of said seal member;

a tapered wedge member disposed in said channel in engagement with said one seal means and said another portion of said seal member so as to cause said one seal means to press against the margin of one face of said slide and urge said slide into engagement with the other of said seal means, the amount of force exerted on said resilient seal means by said wedge member being a function of the depth of penetration of said channel by said wedge member; and means for locking said seal member and said wedge member to said guide member, said locking means comprising fasteners that are engaged with said wedge member and extend through said wedge member and said seal member to said guide member, and means responsive to rotation of said fasteners for changing the effective length of said fasteners relative to said guide member, whereby to vary the extent of penetration of said channel by said wedge member.

18. A seal assembly according to claim 17 wherein said fasteners have threaded shanks, and said means responsive to rotation of said fasteners comprise nuts screwed onto said shanks and engaged with said guide member.

* * * * *